US009290370B1

(12) United States Patent
Panio et al.

(10) Patent No.: US 9,290,370 B1
(45) Date of Patent: Mar. 22, 2016

(54) HYDRAULIC LIFTING APPARATUS

(71) Applicant: HLBP DESIGN CORP., Pelham, NY (US)

(72) Inventors: Michael T. Panio, Whitestone, NY (US); Jeffrey Baynon, Pelham, NY (US)

(73) Assignee: HLBP DESIGN CORP., Pelham, NY (US)

( * ) Notice: Subject to any disclaimer, the term of this patent is extended or adjusted under 35 U.S.C. 154(b) by 391 days.

(21) Appl. No.: 13/621,513

(22) Filed: Sep. 17, 2012

Related U.S. Application Data

(63) Continuation-in-part of application No. 12/880,824, filed on Sep. 13, 2010, now abandoned.

(51) Int. Cl.
*B66F 19/00* (2006.01)

(52) U.S. Cl.
CPC ..... *B66F 19/005* (2013.01); *B66F 19/00* (2013.01)

(58) Field of Classification Search
CPC ..... B66C 1/28; B66C 1/30; B66C 1/32; B66C 19/005; E02D 29/1445; B60P 1/025; Y10S 414/13
USPC ..... 254/133 R; 29/426.1
See application file for complete search history.

(56) References Cited

U.S. PATENT DOCUMENTS

| | | | | |
|---|---|---|---|---|
| 1,716,188 | A | | 6/1929 | Rekenthaler |
| 1,822,629 | A | | 9/1931 | McIlvried |
| 1,957,719 | A | | 5/1934 | Naugle et al. |
| 2,554,433 | A | | 5/1951 | Warren |
| 2,747,535 | A | | 5/1956 | Curry |
| 2,946,618 | A | | 7/1960 | Klahn et al. |
| 2,951,725 | A | | 9/1960 | St. Jean |
| 3,035,336 | A | * | 5/1962 | McConnell ..... 29/240 |
| 3,164,406 | A | | 1/1965 | Barry |
| 3,627,157 | A | | 12/1971 | Blatchly |
| 3,695,667 | A | | 10/1972 | Dempsey |
| 3,695,670 | A | | 10/1972 | Barnett et al. |
| 3,797,676 | A | * | 3/1974 | McCarthy ..... 414/592 |
| 3,861,649 | A | | 1/1975 | Mosley |
| 3,899,205 | A | | 8/1975 | Lanigan et al. |
| 4,136,903 | A | | 1/1979 | Roethler |
| 4,181,290 | A | | 1/1980 | Affolter |
| 4,252,358 | A | * | 2/1981 | Klebs ..... 294/67.33 |
| 4,256,429 | A | * | 3/1981 | Dwyer ..... 414/626 |
| 4,482,182 | A | | 11/1984 | Mortensen |
| 4,488,706 | A | | 12/1984 | Kono |
| 4,826,388 | A | | 5/1989 | Golding |

(Continued)

FOREIGN PATENT DOCUMENTS

| | | | |
|---|---|---|---|
| DE | 1228380 B | * | 11/1966 |
| GB | 1500632 A | * | 2/1978 |

(Continued)

*Primary Examiner* — Lee D Wilson
*Assistant Examiner* — Joel Crandall
(74) *Attorney, Agent, or Firm* — Venable LLP

(57) ABSTRACT

A lifting apparatus for lifting a rectangular manhole cover includes an elongated frame having first and second end assemblies each supporting a hook adapted to engage a corresponding lifting block on a rectangular manhole cover, at least one end assembly being movable with respects to the other end assembly to expand a distance between the hooks. An actuator moves movable end assembly to change the distance between the hooks and force the hooks into engagement with the lifting blocks on an adjacent rectangular manhole cover.

17 Claims, 5 Drawing Sheets

(56) References Cited

U.S. PATENT DOCUMENTS

| | | | | | |
|---|---|---|---|---|---|
| 4,928,927 | A | * | 5/1990 | Fredrick et al. | 254/279 |
| 4,973,094 | A | * | 11/1990 | Tana et al. | 294/81.21 |
| 4,991,893 | A | | 2/1991 | Gordon et al. | |
| 5,141,386 | A | | 8/1992 | Barwise | |
| 5,165,661 | A | | 11/1992 | Wright | |
| 5,338,150 | A | * | 8/1994 | Focke et al. | 414/799 |
| 5,403,057 | A | * | 4/1995 | Sugito et al. | 294/119.1 |
| 5,429,490 | A | * | 7/1995 | Myers et al. | 425/436 R |
| 5,458,435 | A | | 10/1995 | Kohno | |
| 5,997,064 | A | * | 12/1999 | Orita | 294/119.1 |
| 6,019,565 | A | * | 2/2000 | Gesuale | 414/458 |
| 6,439,628 | B1 | | 8/2002 | Eslambolchi et al. | |
| 6,595,566 | B1 | | 7/2003 | Donnan | |
| 6,749,392 | B1 | | 6/2004 | Adams et al. | |
| 6,964,407 | B1 | | 11/2005 | Butler | |
| 7,387,463 | B2 | | 6/2008 | Winn, Jr. | |
| 7,562,923 | B2 | * | 7/2009 | Han et al. | 294/119.1 |
| 8,226,140 | B1 | * | 7/2012 | Dietrich et al. | 294/119.1 |
| 8,444,366 | B2 | * | 5/2013 | Cole | 414/607 |
| 2001/0032972 | A1 | | 10/2001 | Fillisetti | |
| 2004/0135389 | A1 | | 7/2004 | Helms | |
| 2006/0118653 | A1 | * | 6/2006 | Shivak | 239/166 |
| 2008/0159810 | A1 | | 7/2008 | Myers | |

FOREIGN PATENT DOCUMENTS

| | | | | |
|---|---|---|---|---|
| GB | 2109766 | A | * | 6/1983 |
| GB | 2219984 | A | * | 12/1989 |
| GB | 2415007 | A | * | 12/2005 |
| JP | 06136775 | A | | 5/1994 |
| JP | 11323984 | A | | 11/1999 |

* cited by examiner

HYDRAULIC LIFTING APPARATUS

CROSS-REFERENCE TO RELATED APPLICATION

The present application is a continuation-in-part of copending U.S. patent application Ser. No. 12/880,824, filed Sep. 13, 2010.

FIELD OF INVENTION

The invention relates in general to a hydraulic lifting apparatus and, more particularly, to a hydraulic lifting apparatus used to lift rectangular manhole covers, street gratings, and the like.

BACKGROUND OF INVENTION

Underground utility installations (such as sewer pipes, electrical cable conduits, and the like) have become increasingly complex. This increasing complexity often requires frequent access by construction or maintenance personnel in order to install new utilities or upgrade and maintain existing utilities. Since these utility installations are located underground, access to them is generally accomplished through an entrance hole set at ground level. Personnel typically descend through the entrance hole into a vertical access conduit that permits access to the utility installations. These access conduits are commonly referred to as "manholes".

The entrance hole of the access conduit is usually closed with some type of cover, such as a manhole cover or grating. These manhole covers can be of different shapes and sizes (circular, rectangular, etc.) depending upon the degree of access required or the type of access conduit that is in use. To ensure safety, security, and durability, manhole covers are typically constructed of a rigid material, such as cast iron. As a result, the manhole covers can be very heavy and difficult to lift, and may pose a safety risk to personnel who attempt to remove a manhole cover for entry into an access conduit.

One particular problem associated with lifting manhole covers is the danger associated with gas build-up within the access conduit under certain circumstances. Removal of the manhole cover may cause ignition of the gas, resulting in an explosion. Any personnel who are in close proximity to the access conduit therefore face severe danger and the possibility of extreme injury. Accordingly, there is a need for an apparatus that provides efficient and convenient manhole cover removal and replacement and at the same time keeps personnel safe by allowing such removal and replacement to be performed by personnel from a sufficient distance from the manhole cover and access conduit. In particular, there is a need for an apparatus that may be used to remove and replace rectangular manhole covers.

SUMMARY OF INVENTION

The invention described herein is intended to addresses the above needs. In particular, it is an objective of the invention to provide an apparatus that facilitates the efficient and convenient removal and replacement of rectangular manhole covers. Another objective of the invention is to permit personnel to safely perform such removal and replacement from a sufficient distance from the rectangular manhole cover and the access conduit.

To achieve these and other objectives, the invention provides a hydraulic lifting apparatus that permits safe and convenient removal and replacement of a rectangular manhole cover. An embodiment of the invention provides a lifting member operably connected to a hydraulic actuation device and a plurality of lifting hooks. The hydraulic lifting device may be configured to be lifted by appropriate rigging equipment, such as a crane, and the hydraulic actuation device may be activated by personnel from a location that is not in close proximity to the rectangular manhole cover and access conduit. In operation, one embodiment of the invention provides for the activation of the hydraulic actuation device that causes the plurality of lifting hooks to securely interface with lifting blocks that are provided on the rectangular manhole cover. After the lifting hooks are securely interfaced with the lifting blocks, the hydraulic lifting apparatus and the rectangular manhole cover may be lifted by an appropriate rigging structure. When the rectangular manhole cover is replaced, the hydraulic actuation device may be de-activated to allow release of the lifting hooks from the lifting blocks of the rectangular manhole cover.

According to an alternate embodiment of the present invention, a lifting apparatus is disclosed for lifting a rectangular manhole cover, which includes an elongated frame having first and second end assemblies each supporting a hook adapted to engage a corresponding lifting block on a rectangular manhole cover. At least one end assembly is movable with respects to the other end assembly to expand a distance between the hooks. An actuator moves the movable end assembly to increase distance between the hooks and force the hooks into engagement with the lifting blocks on an adjacent rectangular manhole cover.

BRIEF DESCRIPTION OF DRAWINGS

The features, objects, and advantages of the inventions of this invention will become more apparent from the detailed description set forth below when taken in conjunction with the drawings in which like reference characters identify correspondingly throughout and wherein.

DETAILED DESCRIPTION OF THE INVENTION

The principles of the present invention and their advantages are best understood by referring to the illustrated embodiment depicted in FIGS. 1-5 of the drawings, in which like numbers designate like parts.

Figure 1:
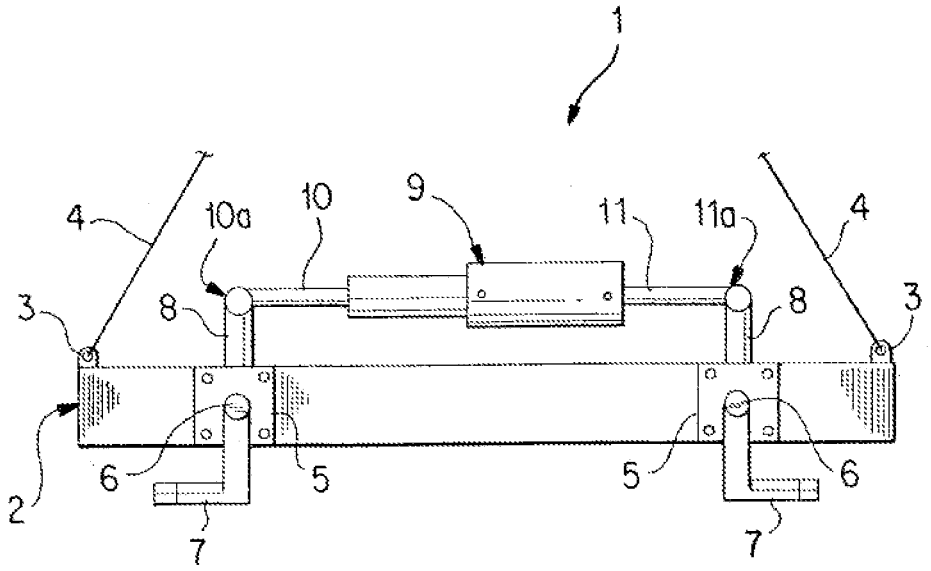
FIG. 1 is a side view of a hydraulic lifting apparatus in accordance with one embodiment of the invention.
Figure 2:
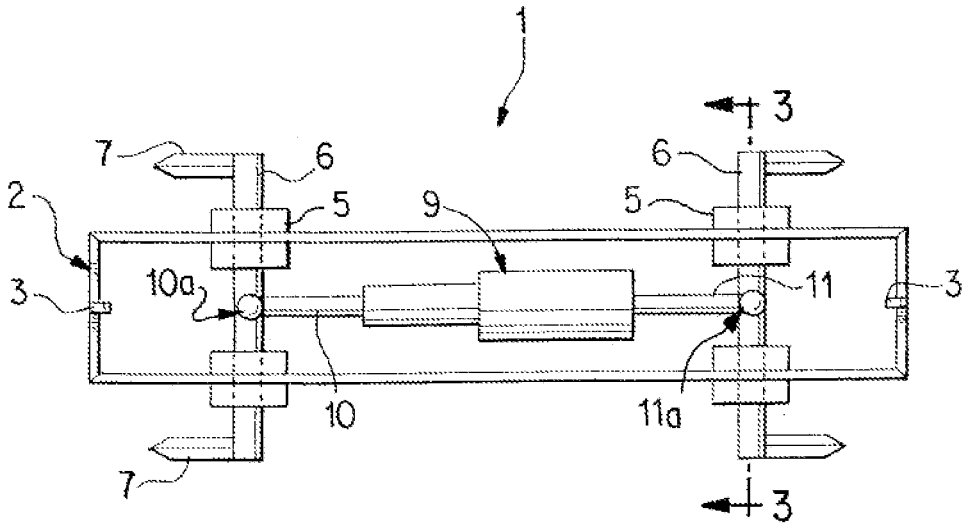
FIG. 2 is a top view of the hydraulic lifting apparatus shown in FIG. 1.

A hydraulic lifting apparatus 1 in accordance with one embodiment of the invention is shown in FIGS. 1 and 2. Hydraulic lifting apparatus 1 includes a lifting member 2. Lifting member 2 may be of any suitable construction. In the embodiment of the hydraulic lifting apparatus 1 shown in FIGS. 1 and 2, the lifting member 2 has an elongated box-type structure, constructed of four steel plates fastened together in a suitable fashion, for example, by welding. Alternatively, lifting member 2 could be constructed of a frame that includes tubular members. Lifting member 2 preferably includes a plurality of lifting points 3 to which an appropriate rigging structure may be affixed in order to lift the complete hydraulic lifting apparatus 1 with rigging or lifting equipment, such as, a crane. For example, rigging lines 4 may be attached to lifting points 3. Rigging lines 4 may be constructed of steel wire, chain, or any other suitable material known in the art.

Fastened to the lifting member 2 are a plurality of bearing plates 5. Bearing plates 5 may be fastened to lifting member 2 with bolts (as shown), by welding, or may be integral with the steel plates that form the lifting member 2. As shown in FIG. 2, rods 6 are positioned through holes in the bearing plates 5 and corresponding holes of the steel plates that form the long sides of lifting member 2. Appropriate means (not shown) to secure the rods 6 in the axial direction may be incorporated as is well known in the art. Rods 6 may be of any suitable cross-sectional shape, such as, for example, round, square, or hexagonal.

Affixed to the rods 6 in a suitable fashion, such as, for example, by welding, are a plurality of lifting hooks 7 that may extend in the downward direction (e.g., towards the ground). Alternatively, lifting hooks 7 may removable from the rods 6 in a manner that permits disconnection and replacement with either a new lifting hook 7 of the same type, or a hook of a different type, depending upon the size of the rectangular manhole cover being lifted by the hydraulic lifting apparatus 1 or the particular location and structure of pockets 13 and lifting blocks 14 that are integral with the rectangular manhole cover, as shown, for example, on rectangular manhole cover 12 in FIG. 4. Lifting hooks 7 may be affixed to the ends of rods 6, or may be affixed at a position offset from the ends, towards the center of rods 6.

Figure 3:
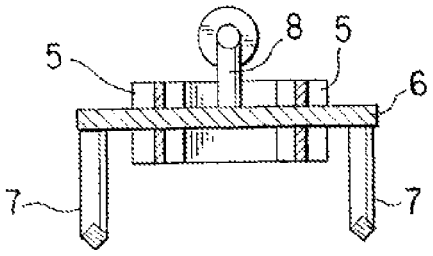
FIG. 3 is a sectional view of the hydraulic lifting apparatus shown in FIG. 2, taken along line A-A.

As shown in FIGS. 1 and 3, arms 8 are affixed to the rods 6 in a suitable fashion, such as, for example, by welding. Arms 8 may extend from rods 6 in the upward direction (e.g., away from the ground). As shown in FIGS. 1 and 2, the hydraulic lifting apparatus 1 includes a hydraulic actuation device. Hydraulic actuation device includes a hydraulic piston 9 with actuation members 10 and 11. In accordance with an embodiment of the invention, hydraulic actuation device may be operated by personnel from an appropriate distance by suitable connections and control equipment (not shown) as are known in the art. Activation of the hydraulic piston 9 causes actuation members 10 and 11 to translate in a manner such that the ends of actuation members 10 and 11, 10*a* and 11*a*, respectively, move towards one another. The ends 10*a* and 11*a* of actuation members 10 and 11 are coupled to the top end of arms 8, as shown. Preferably, the coupling of ends 10*a* and 11*a* to arms 8 may be disengaged, to allow for maintenance and/or replacement of hydraulic activation device, or any of its component parts.

Figure 4:
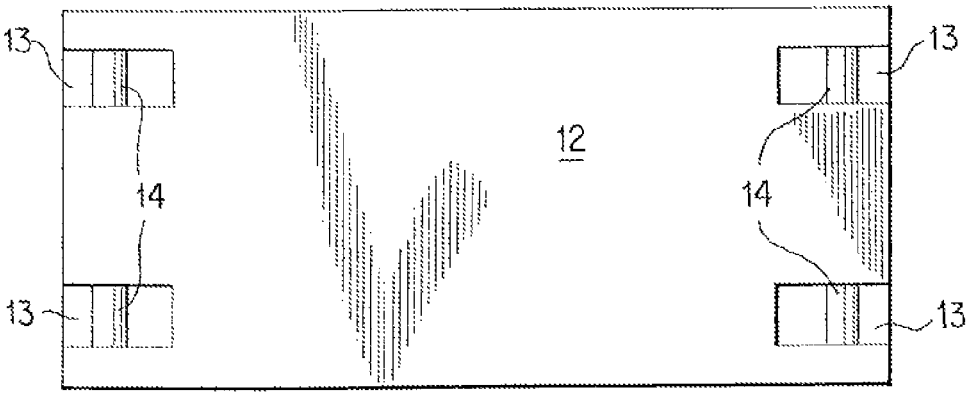
FIG. 4 is a top view of one type of rectangular manhole cover with which a hydraulic lifting apparatus in accordance with one embodiment of the invention may be used.

FIG. 4 shows one type of rectangular manhole cover used to cover an access conduit that may be lifted and replaced using an embodiment of the hydraulic lifting apparatus 1. Rectangular manhole cover 12 includes an interface structure. For example, the interface structure of rectangular manhole cover 12 may include a plurality of pockets 13. Integral with each pocket 13 is a lifting block 14 positioned such that lifting hook 7 may be inserted into the pocket 13 and under lifting block 14 to form an interface, or engagement, between the lifting hook 7 and the lifting block 14 and allow the rectangular manhole cover 12 to be lifted from the access conduit.

In operation, hydraulic lifting apparatus 1 is affixed to an appropriate rigging structure at lifting points 3 by rigging lines 4. Rigging lines 4 may be affixed to appropriate rigging or lifting equipment, such as a crane or similar device. The hydraulic lifting apparatus 1 is moved into a position over the rectangular manhole cover 12, and is lowered to allow lifting hooks 7 to be inserted into pockets 13. The hydraulic piston 9 is then activated by personnel from a remote location. As described above, activation of the hydraulic piston 9 causes ends 10*a* and 11*a* of actuation members 10 and 11 to move towards one another. Movement of ends 10*a* and 11*a* in this manner causes arms 8, rods 6, and lifting hooks 7 to rotate about the axis of rods 6. This rotation results in a secure interface between lifting hooks 7 and lifting blocks 14. After a secure interface is achieved, the hydraulic lifting device 1 and the rectangular manhole cover 12 may be lifted as one piece by suitable rigging equipment, removing rectangular manhole cover 12 from the top of the access conduit.

To replace the rectangular manhole cover 12 onto the top of the access conduit, the hydraulic lifting device 1 and rectangular manhole cover 12 are appropriately positioned over the access conduit, again using suitable rigging equipment. The hydraulic lifting device 1 and rectangular manhole cover 12 are then lowered such that rectangular manhole cover 12 is placed on top of the access conduit. Hydraulic piston 9 may then be de-actuated by personnel from a remote location such that ends 10*a* and 11*a* of actuation members 10 and 11 move away from one another. The movement of ends 10*a* and 11*a* in this manner causes arms 8, rods 6, and lifting hooks 7 to rotate about the axis of rods 6 in a rotational direction opposite from when the lifting hooks 7 of hydraulic lifting apparatus 1 are being securely interfaced with the lifting blocks 14 of the rectangular manhole cover 12. This opposite rotation results in the release of lifting hooks 7 from lifting blocks 14. After release, the hydraulic lifting apparatus 1 may be removed and the rectangular manhole cover 12 is securely replaced on the access conduit.

In view of the above description, it will be seen that the several objects of the invention are achieved and other advantageous results obtained. As various changes could be made to the embodiments described without departing from the scope of the invention, it is intended that all matter contained in the above description or shown in the accompanying drawings shall be interpreted as illustrative and not so as to limit the scope of the invention.

FIGS. 5A-5D are respectively perspective, top, side and end views of a hydraulic rectangular manhole cover lifting apparatus 20 according to another embodiment of the invention. Lifting apparatus 20 is particularly suited for lifting rectangular manhole covers such as rectangular manhole cover 12 shown in FIG. 4, although it may be used in other applications, as well.

Lifting apparatus 20 includes a generally rectangular frame having longitudinal frame members 21*a*-21*b* and lateral frame members 22*a*-22*b*. Longitudinal frame members 21*a*-21*b* and lateral frame members 22*a*-22*b* are preferably made of metal, such as steel, and can be one of a number of possible constructions, including tubular, solid, or channel, among others. In the illustrated embodiment, longitudinal frame members 21*a*-21*b* are of a channel construction and lateral frame members 22*a*-22*b* are of a tubular construction.

A first pair of rectangular tubular members 23*a*-23*b* attach lateral frame member 22*b* to longitudinal frame members 21*a*-21*b*. In particular, each tubular support 23*a*-23*b* includes an outer sidewall attached to a corresponding end of lateral frame member 22*b*, for example by welding or bolts. The inner sidewalls of rectangular tubular members 23*a*-23*b* form a rectangular tube for receiving one end of a corresponding longitudinal frame member 21*a*-21*b*. Together, rectangular tubular members 23*a*-23*b* and lateral frame member 22*b* form an end assembly, which is preferably fixed relative to longitudinal frame members 21*a*-21*b* during the lifting operations described below.

Figure 5A:
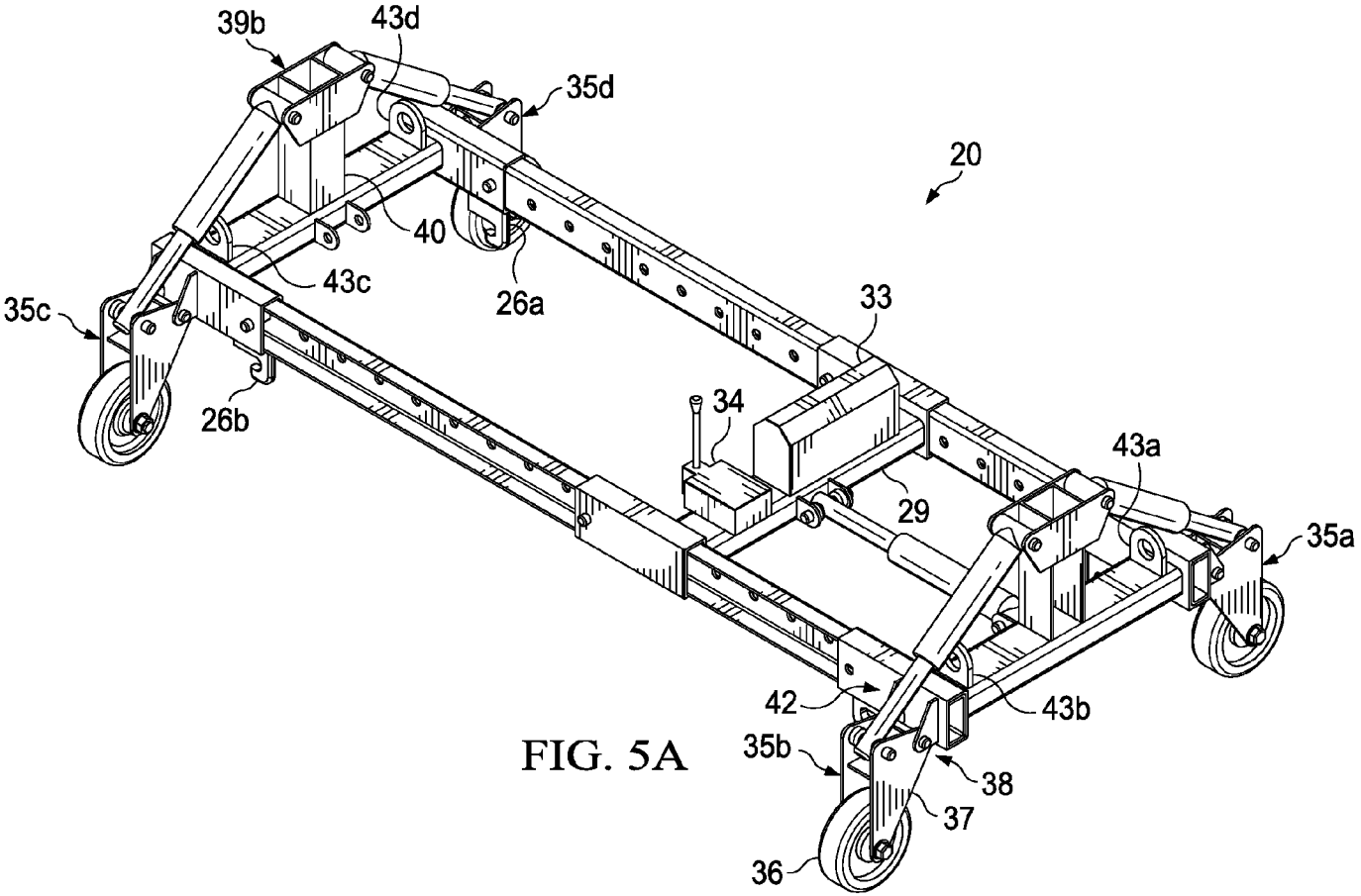
FIG. 5A is a perspective view of a hydraulic lifting apparatus according the another embodiment of the invention.
Figure 5B:
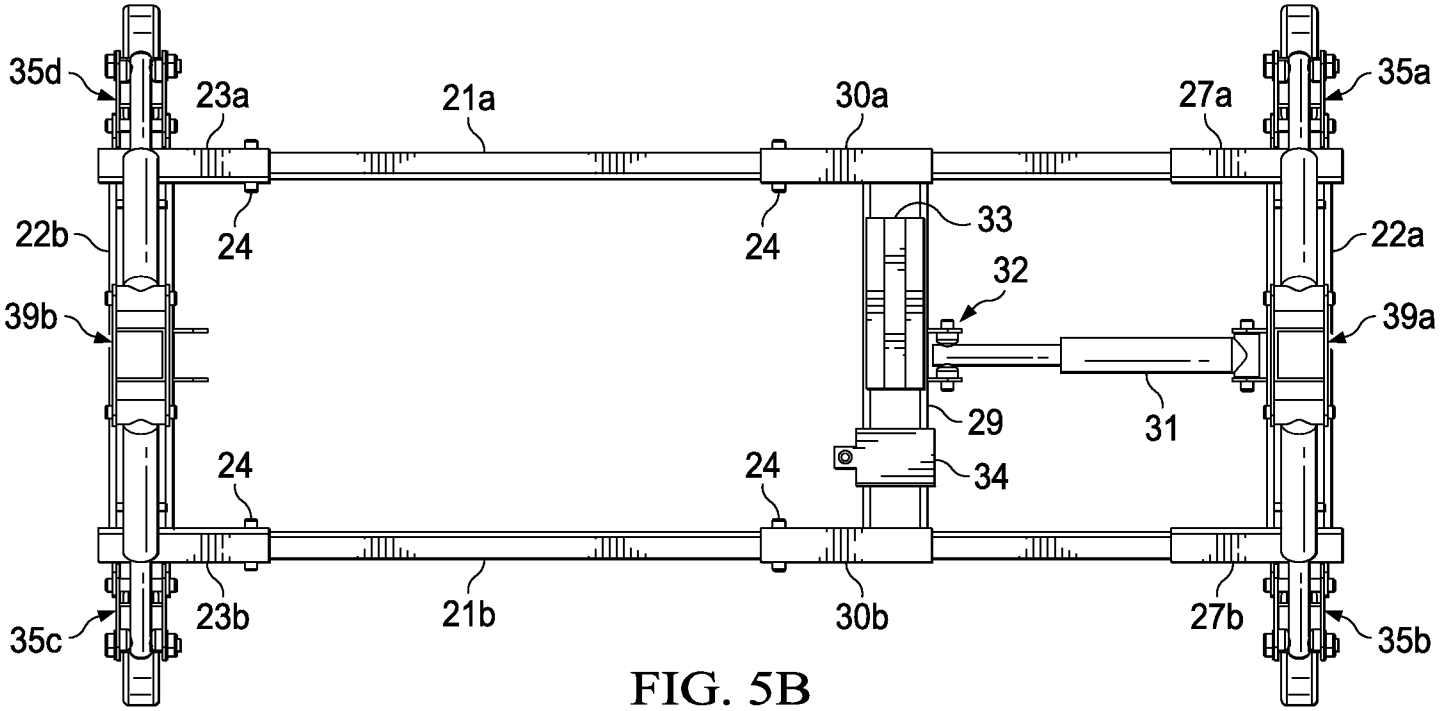
FIG. 5B is a top view of the hydraulic lifting apparatus of FIG. 5A.
Figure 5C:
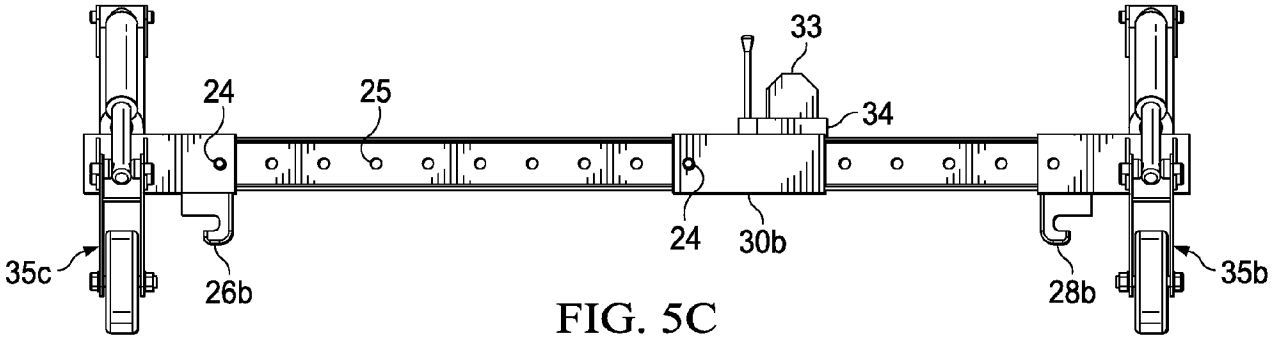
FIG. 5C is a side view of the hydraulic lifting apparatus of FIG. 5A.

The fixed end assembly comprised of lateral frame member 22*b* and rectangular tubular members 23*a*-23*b* is selectively positioned along longitudinal frame members 21*a*-21*b* and held in place by bolts or pins 24 that extend through apertures 25 in the vertical walls of longitudinal frame members 21*a*-21*b* (FIG. 5C). The position of the fixed end assembly (lateral frame member 22*b* and rectangular tubular members 23*a*-23*b*) along longitudinal frame members 21*a*-21*b* may change through the use of pins 24 and apertures 24, depending, for example, on the spacing of the lifting blocks 14 and pockets 13 on the manhole cover to be lifted.

A first set of hooks 26*a*-26*b* extend downward from the bottom walls of rectangular tubular members 23*a*-23*b*, respectively (FIG. 5A). In the illustrated embodiment, hooks 26*a*-26*b* are adapted to engage one pair of lifting blocks 14 on manhole cover 12 of FIG. 4.

Figure 5D:
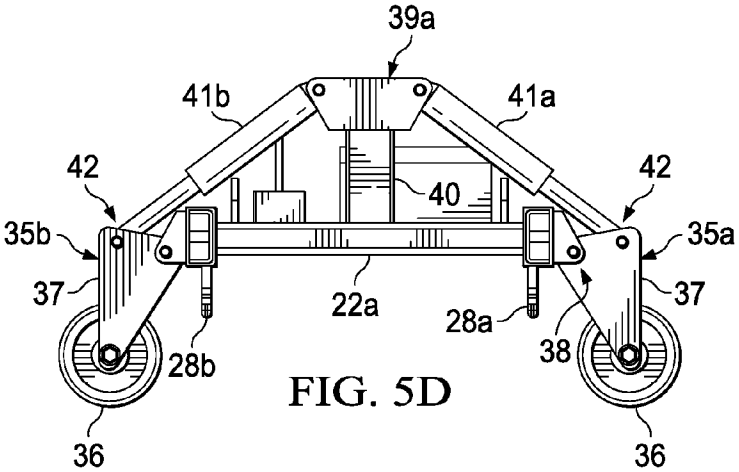
FIG. 5D is an end view of the hydraulic lifting apparatus of FIG. 5A.

A second pair of rectangular tubular members 27*a*-27*b* attach lateral frame member 22*a* to longitudinal frame members 21*a*-21*b*. The end assembly comprised of rectangular tubular members 27*a*-27*b* and lateral frame member 22*a* is allowed to move (i.e., slide) along a part of the length of longitudinal frame members 21*a*-21*b* during lifting operations A second set of hooks 28*a*-28*b* extend downward from the bottom walls of rectangular tubular members 27*a*-27*b*, respectively (FIG. 5D). In the illustrated embodiment, hooks 28*a*-28*b* are adapted to engage a second pair of lifting blocks 14 on manhole cover 12 of FIG. 4.

A central lateral support member 29 is supported between longitudinal frame members 21*a*-21*b* by rectangular tubular members 30*a*-30*b*. Central lateral support 29 is positioned along longitudinal frame members 21*a*-21*b* and held into place with pins 24 and apertures 25. The position of central lateral support member 29 along longitudinal frame members 21*a*-21*b* may change through the use of pins 24 and apertures 24, depending, for example, on the spacing of lifting blocks 14 and pockets 13 and the resulting required positioning of the movable end assembly of lateral frame member 22*a* and rectangular tubular members 27*a*-27*b*.

The movable shaft of a horizontal hydraulic piston assembly 31 attaches to central lateral support member 29 with assembly 32. The end of the body of horizontal piston assembly 31 is fastened to lateral frame member 22*a*. Central lateral support member 29 also supports a four-way hydraulic flow divider 33 and a control valve 34, both of which are discussed below.

Four wheel assemblies 35*a*-35*d* are located at corresponding corners of lifting apparatus 20. Each wheel assembly includes a wheel 36 and a wheel support bracket 37. Each wheel support bracket 37 pivots vertically in conjunction with assemblies 37 on corresponding rectangular tubular member pairs 23*a*-23*b* and 27*a*-27*b*.

In the illustrated embodiment, the pivoting of wheel assemblies 35*a*-35*d* is implemented with vertical hydraulic units 39*a* and 39*b*, which in turn vertically raises and lowers lifting apparatus 20 to allow lifting and moving manhole cover 14.

Each vertical hydraulic unit 39 includes a support structure 40 extending from lateral frame members 22*a*-22*b* and vertical hydraulic piston assemblies 41*a*-41*b* extending at an angle downwardly from the top of support structure 40 (FIG. 5C). In the illustrated embodiment, the bodies of vertical hydraulic piston assemblies 41*a*-41*b* are attached to upper ends of the corresponding support structure 40 and the ends of the moving piston shafts are attached to a point on the corresponding wheel assembly support frame 37. Handles (not shown) may be inserted into the tubular structure of one or both of support structures 40 to allow manual movement of lifting apparatus 20.

Use of vertical hydraulic units 39*a*-39*b* is not required. In alternate embodiments, vertical movement hydraulic units 39*a*-39*b* may be eliminated from lifting apparatus 20 in their entirety. Lifting rings 43*a*-43*d* at the corners of lifting apparatus 20 are provided for engaging a crane or the like as an alternative means of raising and lowering lifting apparatus 20 and any engaged manhole cover.

For clarity, the conventional hydraulic hoses and hydraulic driving source used for actuating horizontal piston assembly 31 and vertical hydraulic piston assemblies 41*a*-41*b* are not shown. Generally, conventional horizontal piston assembly 31 includes two hydraulic ports, one for receiving fluid under pressure to extend the piston shaft and another for receiving fluid under pressure for retracting the piston shaft. Each of these ports is connected by a hose and couplings to a corresponding port on control valve 34. Control valve 34 also includes another of ports that exchange fluid through a pair of hoses with a conventional hydraulic pump or pressure unit.

Four-way hydraulic flow divider 33 also exchanges fluid under pressure with a conventional hydraulic pump or pressure unit through a pair of hoses. Each vertical hydraulic piston assembly 41 includes two ports, one for extending the piston shaft and one for retracting the piston shaft. Two hoses are then provided between four-way hydraulic flow divider 33 and each of the four vertical hydraulic piston assemblies 41 to provide pressure for lifting and lowering lifting apparatus 20.

In operation, lifting apparatus 20 is positioned such that hooks 26*a*-26*b* and 28*a*-28*b* are within pockets 13 of manhole cover 12, and aligned, but not yet engaged, with lifting blocks 14. In embodiments with wheel assemblies wheel assemblies 35*a*-35*d* and vertical movement hydraulic units 39*a*-39*b*, lifting apparatus is rolled into place and wheel assemblies 35*a*-35*d* rotated upward to lower hooks 26*a*-26*b* and 28*a*-28*b* into pockets 13. If only hooks 43*a*-43*d* are available or being used, then lifting apparatus 20 can be lowered into position with a crane.

Once the hooks are in position, piston assembly 31 is manually activated using control valve 33. As the shaft of piston assembly 31 extends, the movable end assembly (rectangular tubular members 27*a*-27*b* and lateral frame member 22*a*) slides outward along longitudinal frame members 21*a*-21*b* and away from central lateral member 29. The corresponding end of lifting assembly slides on the surfaces of the corresponding wheels 36 until hooks 28*a*-28*b* engage the corresponding lifting blocks 14.

The hydraulic pressure provided to piston assembly 31 now forces fixed central lateral support member 29 away from the now engaged hooks 28*a*-28*b*, which continues to increase the distance between hooks 28*a*-28*b* and hooks 26*a*-26*b*. This causes hooks 26*a*-26*b* on the fixed end assembly (lateral frame member 22*b* and rectangular tubular members 23*a*-23*b*) to slide outward into their corresponding lifting blocks 14. Piston assembly 31 continues to increase the lateral force until all of hooks 28*a*-28*b* and hooks 26*a*-26*b* are forced into hard engagement with the corresponding lifting blocks 14. Lifting apparatus 20 is now secured to manhole cover 12.

In other words, piston assembly 31 expands the distance between fixed hooks 26*a*-26*b* and movable hooks 28*a*-28*b* until lifting apparatus 20 is securely engaged with manhole cover 20.

In embodiments with wheel assemblies 35*a*-35*d* and vertical movement hydraulic units 39*a*-39*b*, the operating personnel can move to a safe distance from the manhole cover 14 being lifted. Hydraulic fluid under pressure is then remotely provided to hydraulic piston assemblies 41*a*-41*b* causing wheel assemblies 35*a*-35*b* to rotate downward and lift manhole cover 12 upward. Lifting apparatus 20 and engaged manhole cover 12 can be subsequently rolled away from the access conduit. Alternatively, lifting apparatus and engaged manhole cover 12 can be lifted using a crane and hooks 43*a*-43*b*.

To replace manhole cover 12, lifting apparatus 20 and engaged manhole cover 12 are rolled back into alignment with the access conduit and the hydraulic pressure on hydraulic piston assemblies 41*a*-41*b* is released. Wheel assemblies 35*a*-35*d* pivot upward and cover 12 is lowered downward to the access conduit. Alternatively, lifting apparatus and engaged manhole cover 12 are returned to the access conduit using a crane and hooks 43*a*-43*b*. In each case, lifting apparatus 20 is disengaged from manhole cover 12 by retracting dynamic lateral frame member 22*a* with piston assembly 31 and control valve 34.

Although the invention has been described with reference to specific embodiments, these descriptions are not meant to be construed in a limiting sense. Various modifications of the disclosed embodiments, as well as alternative embodiments of the invention, will become apparent to persons skilled in the art upon reference to the description of the invention. It should be appreciated by those skilled in the art that the conception and the specific embodiment disclosed might be readily utilized as a basis for modifying or designing other structures for carrying out the same purposes of the present invention. It should also be realized by those skilled in the art that such equivalent constructions do not depart from the spirit and scope of the invention as set forth in the appended claims.

It is therefore contemplated that the claims will cover any such modifications or embodiments that fall within the true scope of the invention.

What is claimed is:

1. A lifting apparatus for lifting a rectangular manhole cover comprising:

an elongated frame having a pair of longitudinal members and having first and second end assemblies extending between the pair of longitudinal members, the first and second end assemblies each supporting a hook adapted to engage a corresponding lifting block on a rectangular manhole cover, at least one end assembly being movable with respect to the other end assembly to change a distance between the hooks;

a pair of wheel assemblies coupled to opposing ends of each of the first and second end assemblies, at least one of the pair of wheel assemblies being movable with respect to the other pair of wheel assemblies via movement of the at least one movable end assembly; and an actuator configured to move the at least one movable end assembly, wherein, when the actuator is activated, the distance between the hooks increases, wherein at least one of the first and second end assemblies comprises:

a pair of tubes each having an outer wall coupled to a corresponding end of an elongated member and inner walls for receiving a corresponding one of the pair of longitudinal members, and wherein an aperture through the outer and inner walls of each tube is provided for receiving a fastener for insertion through a corresponding aperture through a wall of the received longitudinal member and attaching the first or second end assembly at a selected position along the length of the received longitudinal member.

2. The lifting apparatus of claim 1, wherein the actuator comprises a piston.

3. The lifting apparatus of claim 1, where the piston comprises a hydraulic piston.

4. The lifting apparatus of claim 1, further comprising a hydraulic lifting system coupled to each of the first and second end members for raising the elongated frame and an engaged rectangular manhole cover.

5. A lifting apparatus for engaging a rectangular manhole cover, comprising:

a pair of generally parallel longitudinal members of a selected length;

a pair of generally parallel lateral assemblies coupled to and spacing the longitudinal members, wherein at least one of the lateral assemblies is movable along a portion of the length of the longitudinal members;

at least one hook supported by each lateral assembly for engagement with a corresponding lifting block provided at a face of a rectangular manhole cover;

an actuation device configured to move the movable lateral assembly along a portion of the length of the longitudinal frame members such that a spacing between the lateral assemblies increases, thereby forcing the hooks into secure engagement with the corresponding lifting blocks and securing the lifting apparatus to the rectangular manhole cover; and a central lateral assembly having ends attached to each of the longitudinal members at points between the pair of lateral assemblies, the actuation device being configured to move the movable lateral assembly by applying a force between the central lateral assembly and the movable lateral assembly, wherein at least one of the lateral assemblies comprises:

a pair of tubes each having an outer wall coupled to a corresponding end of an elongated member and inner walls for receiving a corresponding longitudinal member, and wherein an aperture through the outer and inner walls of each tube is provided for receiving a fastener for insertion through a corresponding aperture through a wall of the received longitudinal member and attaching the lateral assembly at a selected position along the length of the received longitudinal member.

6. The lifting apparatus of claim 5, wherein the actuation device comprises a hydraulic piston.

7. The lifting apparatus of claim 5, wherein the at least one movable lateral assembly slides along a portion of the length of the longitudinal members.

8. The lifting apparatus of claim 5, wherein the plurality hooks comprises four lifting hooks spaced apart for insertion under four corresponding lifting blocks provided at the face of the rectangular manhole cover, one pair of hooks supported by each lateral assembly.

9. The lifting apparatus of claim 5, further comprising an actuator system for raising the frame and an engaged manhole cover.

10. The lifting apparatus of claim 9, wherein the actuator system comprises:

a pair of pivoting wheel assemblies coupled to opposing ends of each lateral assembly;

a piston system supported by each lateral assembly for pivoting the corresponding pairs of wheel assemblies to raise the lifting apparatus and engaged rectangular manhole cover.

11. The lifting apparatus of claim 10, wherein each of the pair of pivoting wheel assemblies comprises a first wheel assembly and a second wheel assembly, and wherein the piston system supported by each lateral assembly for pivoting the corresponding pairs of wheel assemblies comprises:

a support structure extending at an angle from the lateral assembly;

a first piston extending at an angle from an end of the support structure to the first wheel assembly; and a second piston extending at an angle from the end of the support structure to the second wheel assembly.

12. The lifting apparatus of claim 5, wherein the movable lateral assembly comprises a pair of tubes each having an outer wall coupled to a corresponding end of an elongated member and inner walls for receiving a corresponding longitudinal member such that the movable lateral member is allowed to slide along a length of the longitudinal members in response to the actuation device.

13. The lifting apparatus of claim 5, wherein one of the hooks is attached to a lower outer wall of each of the pair of tubes.

14. A method for removing a rectangular manhole cover from an access conduit, comprising:

positioning a lifting apparatus adjacent to a rectangular manhole cover including a plurality of lifting blocks, the lifting apparatus comprising:

an elongated frame having first and second end assemblies each supporting a hook adapted to engage a corresponding lifting block, at least one end assembly being movable with respect to the other end assembly to change a distance between the hooks; and an actuator for moving the at least one movable end assembly;

activating the actuator to increase the distance between the hooks to force the hooks into engagement with the lifting blocks on an adjacent rectangular manhole cover; and raising the lifting apparatus after the hooks are engaged with the lifting blocks to lift the rectangular manhole cover.

15. The method of claim 14, wherein the actuator comprises a hydraulic actuator and the activating the actuator comprises providing fluid to the hydraulic actuator to move the movable end assembly.

16. The method of claim 14, wherein the lifting apparatus further comprises a pair of pivoting wheel assemblies coupled to opposing ends of each end assembly and an actuation system for pivoting wheel assemblies and raising the lifting apparatus comprises activating the actuation system to pivot the wheel assemblies to raise the lifting apparatus.

17. The method of claim 16, wherein the actuation system comprises a hydraulic actuation system and raising the lifting apparatus comprises providing fluid to the hydraulic actuator to raise the lifting apparatus.

* * * * *